US005247793A

United States Patent [19]

Yamada et al.

[11] Patent Number: 5,247,793

[45] Date of Patent: Sep. 28, 1993

[54] EXHAUST PURIFICATION SYSTEM FOR MULTIPLE CYLINDER ENGINES

[75] Inventors: Hideki Yamada, Hatsukaichi; Hisashi Zaima, Higashihiroshima; Shigeki Yamashita; Kazuo Tanaka, both of Hiroshima, all of Japan

[73] Assignee: Mazda Motor Corporation, Hiroshima, Japan

[21] Appl. No.: 859,014

[22] Filed: Mar. 30, 1992

[30] Foreign Application Priority Data

Mar. 28, 1991 [JP] Japan ..... 3-064686

[51] Int. Cl.[5] ..... F01N 3/20

[52] U.S. Cl. ..... 60/276; 60/277; 123/688; 123/691; 123/692

[58] Field of Search ..... 60/276, 277; 123/688, 123/691, 692

[56] References Cited

U.S. PATENT DOCUMENTS 4,177,787 12/1979 Hattori ..... 123/688
4,747,267 5/1988 Nagai ..... 123/688
5,074,113 12/1991 Matsuoka ..... 60/276

FOREIGN PATENT DOCUMENTS 60-231155 11/1985 Japan .
64-8332 1/1989 Japan .

*Primary Examiner*—Douglas Hart
*Attorney, Agent, or Firm*—Keck, Mahin & Cate

[57] ABSTRACT

An exhaust purification system has an upstream exhaust gas sensor and a downstream exhaust gas sensor disposed downstream of a catalytic device. Each sensor detects an oxygen concentration in exhaust gases and provides an output which inverts between a lean state, representative of a lean air/fuel ratio, and a rich state, representative of a rich air/fuel ratio, according to oxygen concentrations. The upstream exhaust sensor is determined to have deteriorated when an output from the upstream exhaust sensor is kept in a predetermined correlation with an output from the downstream exhaust sensor while the output from the downstream exhaust sensor remains the same.

5 Claims, 4 Drawing Sheets

(1) EA
1
Eo
0

(2) EB
1
Eo
0

(3) EC
1
Eo
0

(4) FA
1
0

(5) FB
1
0

(6) FC
1
0

(7) T
0

(8) GA
1
0
a
b
c (9) GB
1
0
d
e
TIME

EXHAUST PURIFICATION SYSTEM FOR MULTIPLE CYLINDER ENGINES

BACKGROUND OF THE INVENTION

1. Field of the Invention

The present invention relates to a device for the purification of exhaust gases produced by a multiple cylinder engine and, more particularly, to an exhaust gas purification system for use with a multiple cylinder engine equipped with two independent exhaust systems, each exhaust system being provided with an exhaust sensor.

2. Description of Related Art

Typically, in multiple cylinder engines, such as a V-type engine which has an exhaust system connected to each of two groups of cylinders and an exhaust gas sensor disposed in each exhaust system for detecting the concentration of oxygen within exhaust gases, an engine control system detects an air/fuel ratio of a fuel mixture supplied into each group of cylinders based on the concentration of oxygen within exhaust gases in each exhaust system. Such an engine control system also typically controls a fuel system so that the fuel mixture attains a target air/fuel ratio. Such an engine control system is known from, for example, Japanese patent application No. 62-162,727, entitled "Air/Fuel Ratio Control System," filed on Jun. 30, 1987 and now published as Japanese Unexamined Patent Publication No. 64-8,332.

It is also known from, for instance, Japanese Unexamined Patent Publication No. 60-231,155 to dispose an exhaust sensor downstream of a catalytic converter for purifying exhaust gases in an engine exhaust system. This sensor is used by the system to determine the state of deterioration of the catalyst from a signal produced by the sensor which is representative of exhaust gases.

Such exhaust gas sensors as those used to control the air/fuel ratio of a fuel mixture in the manner described have a detection performance which deteriorates with the passage of time. This results in a "dull" reaction of the exhaust gas sensor to changes in the air/fuel ratio, which can cause a deviation of a controlled air/fuel ratio from a target air/fuel ratio, thereby reducing exhaust gas purification performance.

If the exhaust gas sensor or sensors deteriorate, in an ordinary air/fuel ratio feedback control, what is known as an "inversion cycle" tends to become longer. Because of this, based on the fact that the inversion cycle has become longer than a specified inversion cycle under specific conditions, deterioration of the exhaust gas sensor can be judged to have occurred. However, it is possible that the exhaust gas sensor will be mistakenly judged to have deteriorated, based on its signal, if the change cycle of the air/fuel ratio itself has lengthened due to various other control factors. Therefore, if an inversion cycle, used as a deterioration determination standard, has a large value, then the accuracy of determining deterioration of the exhaust gas sensor is lowered. As a result, the exhaust gas purification continues to be poor. On the other hand, if the inversion cycle, used as a deterioration determination standard, is shortened, erroneous determinations that the exhaust sensor has deteriorated may occur.

When two independent exhaust systems are provided for an engine having two groups of cylinders, such as a V-type engine, an exhaust sensor is provided in each independent exhaust system in order to control the air/fuel ratio of a fuel mixture. In such an engine, it is desired, from a cost and service standpoint, to ascertain a state of deterioration of each exhaust gas sensor in a fairly simple way.

SUMMARY OF THE INVENTION

It is an object of this invention to provide an exhaust gas purification system for engines, having two groups of cylinders, which can accurately detect a state of deterioration of an exhaust gas sensor provided in an independent exhaust system for each group of cylinders.

This object is achieved by providing an exhaust gas purification system which has an upstream exhaust sensor disposed in each independent exhaust system and a downstream exhaust gas sensor disposed after, i.e., downstream of, a catalytic device, in a common downstream portion of the independent exhaust systems.

A simplified basic composition of the exhaust gas purification system is shown in the block diagram of FIG. 1.

Referring to FIG. 1, an engine 10 is shown as having two groups of exhaust cylinders 10*a* and 10*b*. Each group of exhaust cylinders 10*a* and 10*b* has an independent intake system $A_1$ or $A_2$ as well as an independent exhaust system $B_1$ or $B_2$. The independent intake systems $A_1$ and $A_2$ are, respectively, provided with fuel injectors 17*a* and 17*b*, which are controlled by an air/fuel ratio (A/F) adjustment means D to inject fuel so as to regulate or adjust the air/fuel ratio of the fuel mixture. On the other hand, the independent exhaust systems $B_1$ and $B_2$ are, respectively, provided with upstream exhaust gas sensors 20*a* and 20*b*. Signals provided by the upstream exhaust gas sensors 20*a* and 20*b* are sent to an air/fuel ratio control means G. On the basis of the signals, the air/fuel ratio (A/F) control means G controls air/fuel ratio adjustment means D so that it achieves the desired or target air/fuel ratios of the fuel mixture delivered into the respective groups of cylinders corresponding to the respective exhaust systems $B_1$ and $B_2$.

Independent exhaust systems $B_1$ and $B_2$ are integrated together at locations downstream of the exhaust gas sensor 20*a* and 20*b* so as to form a common exhaust system. In the integrated common exhaust system, a gas purification device 21, such as a catalytic converter, for exhaust gas purification and a downstream exhaust gas sensor 22 located downstream of the gas purification device 21 are disposed. Signals provided by the upstream and downstream exhaust gas sensors 20*a*, 20*b* and 22 are output to a deterioration judgement means K. The deterioration judgement means K judges the upstream exhaust gas sensor 20*a* or 20*b* to be in a deteriorated state when an inverted output from each upstream exhaust gas sensor 20*a* or 20*b* is in a specific correlation with an inversion output from the downstream exhaust sensor 22. If it is determined by the deterioration judgement means K that a state of deterioration exists in either of the upstream exhaust gas sensors 20*a* and 20*b*, a warning means M sends a warning message to the vehicle operator, prompting early remedial care.

The deterioration judgement means K is desirably adapted to judge that a state of deterioration exists in the upstream exhaust gas sensor 20*a* or 20*b* when the exhaust gas sensor continuously provides an output indicating a lean state of fuel mixture during the period in which the output of the downstream exhaust sensor 22 indicates a lean state of fuel mixture.

With an exhaust gas purification system constructed in this way, the air/fuel ratio control is basically accomplished so that it corresponds to an output signal of the upstream sensor arranged in each of the independent exhaust systems so as to achieve a target air/fuel ratio. By using this exhaust gas purification system, the desired purification performed by the catalyst device is assured. As long as the upstream exhaust gas sensors operate ordinarily, changes in the air/fuel ratio are small and, therefore, the exhaust gas concentration is fairly stable, due to a reaction with the catalyst, so that there is no inversion in output of the downstream exhaust gas sensor. In addition, even if there is an inversion in output of the downstream exhaust gas sensor under specific conditions, an inversion in output of the upstream exhaust gas sensor is less correlated to the output inversion of the downstream exhaust gas sensor. Therefore, no deterioration determination is performed by the deterioration ascertainment means under these specific conditions.

On the other hand, if a deterioration occurs in the upstream exhaust sensor, the air/fuel control accomplished by the air/fuel ratio control means exhibits an increased deviation in air/fuel ratio from the target air/fuel ratio due to a deterioration in sensitivity. This in turn influences the deviation in an air/fuel ratio in the exhaust gases passed through the catalyst device, so as to cause an inversion in output from the downstream exhaust sensor. Additionally, deteriorated upstream exhaust gas sensors exhibit an inversion in their outputs which is highly correlated to the output inversion of the downstream exhaust gas sensors in such a way that their outputs invert to a lean state while the outputs of the downstream exhaust sensors are kept in a lean state. By determining whether or not a state of deterioration exists in the upstream exhaust gas sensors, a warning is given at an appropriate time, enabling the deteriorated upstream exhaust gas sensor or sensors to be promptly replaced.

BRIEF DESCRIPTION OF THE DRAWINGS

The above and other objects and features of the present invention will be apparent to those skilled in the art from the following description of a preferred embodiment when considered in conjunction with the attached drawings, in which.

DETAILED DESCRIPTION OF THE PREFERRED EMBODIMENT

Figure 1:
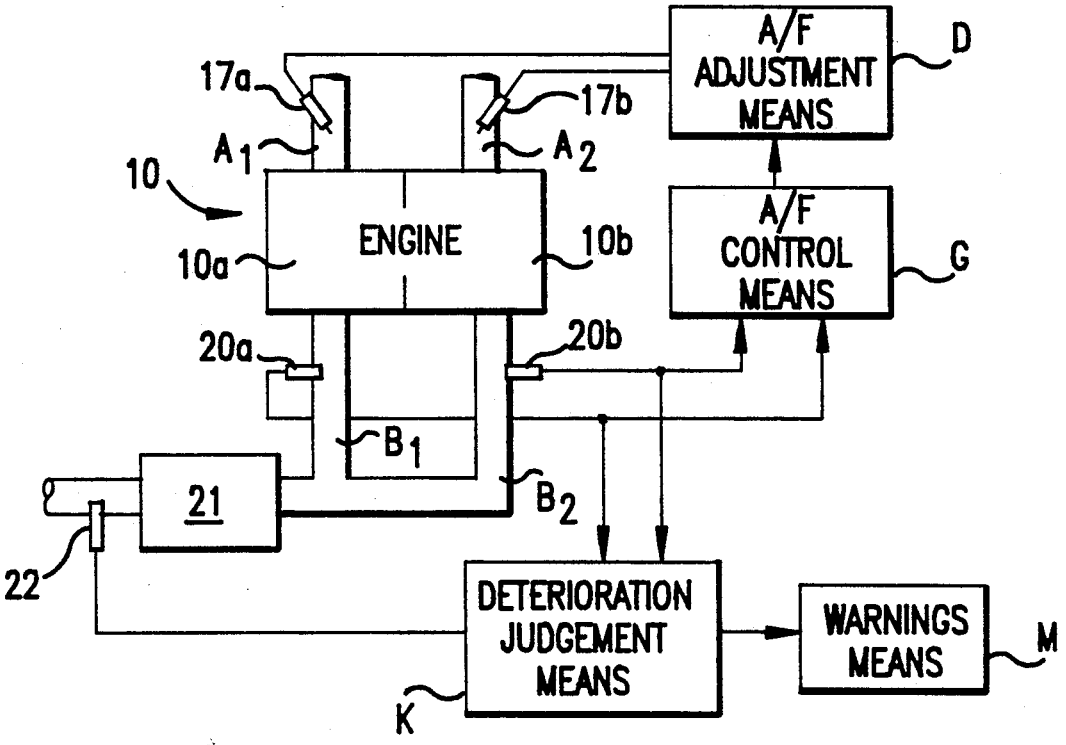
FIG. 1, as noted above, is a block diagram illustrating a basic composition of an exhaust purification system of this invention.
Figure 2:
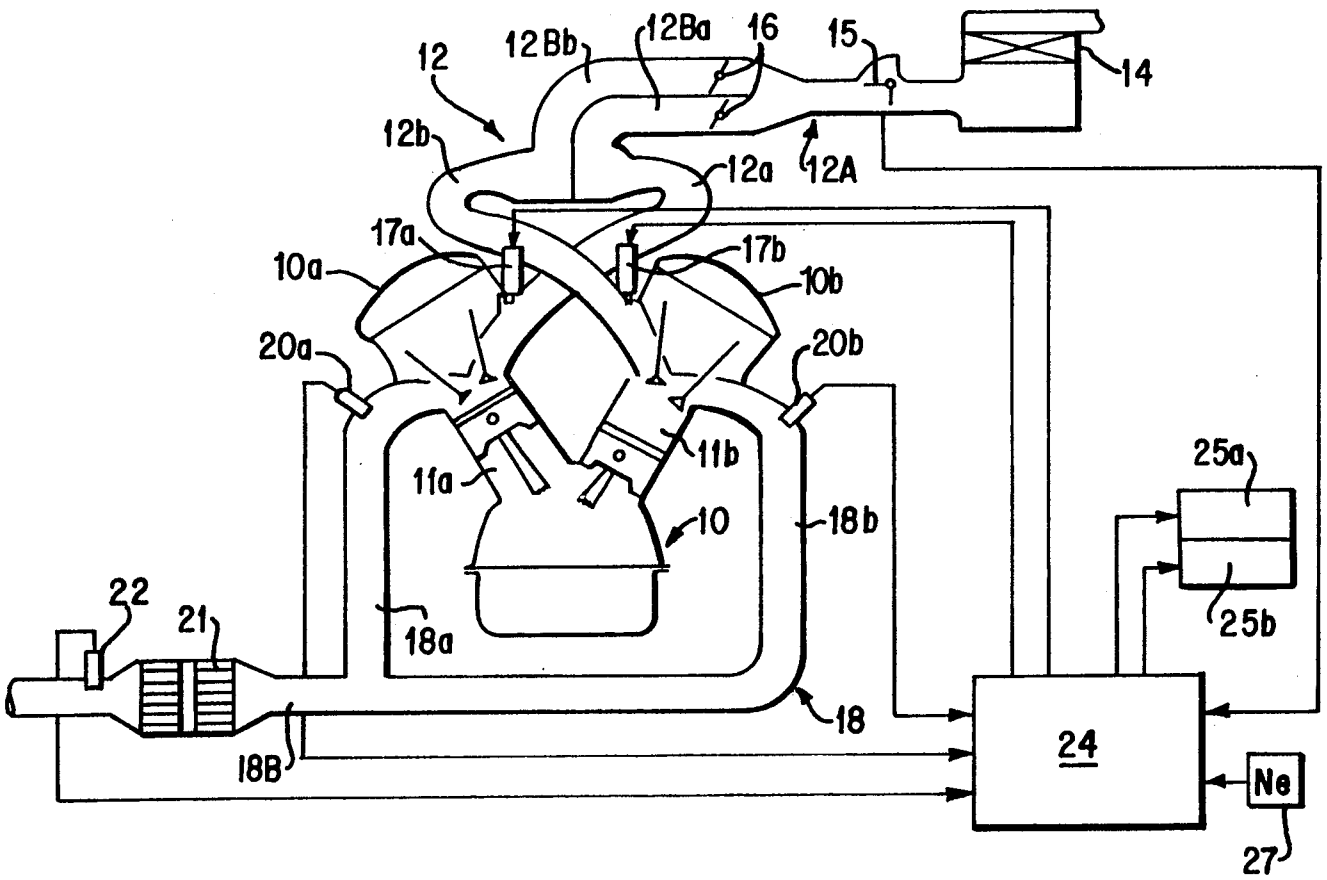
FIG. 2 is a schematic view of a V-type engine equipped with an exhaust purification system in accordance with a preferred embodiment of this invention.
Figures 3A, 3B, 3C, 3D, 3E, 3F, 3G, 3H, 3I:
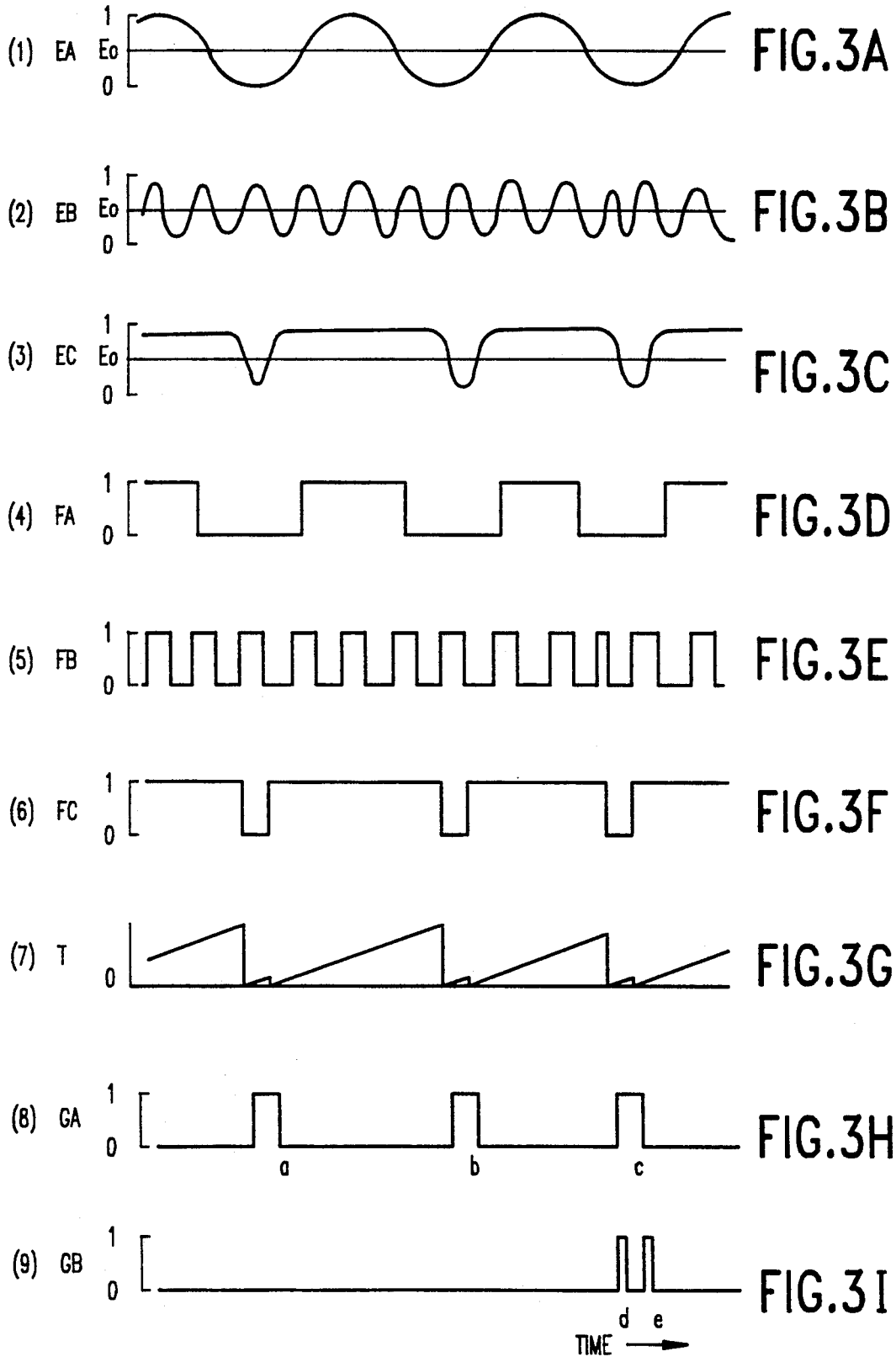
FIGS. 3*a*–3*i* are time charts which explains various conditions of exhaust gas sensors of the exhaust purification system during a deterioration of upstream exhaust gas sensors.

Referring to the drawings in detail and, in particular, to FIG. 2, an internal combustion engine 10, such as a V-type internal combustion engine, is shown. The internal combustion engine is equipped with an exhaust gas purification system in accordance with a preferred embodiment of the present invention and includes right and left cylinder banks 10*a* and 10*b* arranged in a V-formation and at a predetermined relative angle. Cylinders 11 are divided into two groups. The cylinders in each group are disposed in a row in one and the same cylinder bank 10*a* or 10*b*, respectively. An intake system 12 is formed by an upstream intake pipe 12A, right and left intake manifolds 12B*a* and 12B*b*, branching off from the upstream intake pipe 12A, and individual discrete pipes 12*a* and 12*b*. Each intake manifold 12B*a* or 12B*b* is provided, at its upstream end, with a throttle valve 16. Each individual discrete pipe 12*a* is connected to one cylinder of the group of the cylinders 11 of the right cylinder bank 10*a* and is provided at its downstream end with a fuel injector 17*a*. Each individual discrete pipe 12*b* is connected to one cylinder of the group of the cylinders 11 of the left cylinder bank 10*b* and is provided at its downstream end with a fuel injector 17*b*. The intake system 12 has an air cleaner 14 and an air flow sensor 15 which are disposed, in order from the upstream side, in the upstream intake pipe 12A.

An exhaust system 18 includes exhaust manifolds 18*a* and 18*b* for expelling exhaust gases from cylinders 11 of the right and left cylinder banks 10*a* and 1O*b* which are independently connected to the groups of the cylinders 11 of the right and left cylinder banks 10*a* and 10*b*, respectively. The respective independent exhaust manifolds 18*a* and 18*b* are provided with upstream exhaust gas sensors 20*a* and 20*b*, such as $O_2$ sensors, which detect the oxygen concentration in exhaust gases. Based on the detected oxygen concentration, an air/fuel ratio of a fuel mixture is determined. The independent exhaust manifolds 18*a* and 18*b* merge into a single downstream exhaust pipe 18B downstream of the upstream exhaust gas sensors 20*a* and 20*b*. In the downstream exhaust pipe 18B, a catalytic converter 21 is provided for purifying exhaust gases. After the catalytic converter 21, the downstream exhaust pipe 18B is provided with a downstream exhaust gas sensor 22, which detects the oxygen concentration in exhaust gases, based on which an air/fuel ratio of a fuel mixture is also determined.

The quantity of fuel sprayed or injected from the injectors 17*a*, 17*b* is controlled with an injector pulse width obtained from a controller 24, formed mainly by a micro-computer. The injector pulse width is a measurement of how long an injector is kept open and corresponds to a driving condition. The injector pulse width is adjusted by the controller so as to regulate an air/fuel ratio to a desired or target air/fuel ratio based on signals representative of air/fuel ratios from the upstream exhaust gas sensors 20*a* and 20*b* in feedback control. Furthermore, a signal from the downstream exhaust gas sensor 22 is input to the controller 24 and is compared with the signals from the upstream exhaust gas sensors 20*a* and 20*b* in order to judge whether or not the upstream exhaust gas sensors 20*a* and/or 20*b* have deteriorated. If either of the upstream exhaust gas sensors 20*a* and 20*b* is determined to have reached a state of deterioration, then a warning indicator lamp 25*a* or 25*b* is turned on. The controller 24 also receives various signals from the air-flow sensor 15 and an engine speed sensor (Ne) 27 which detects an engine speed.

Air/fuel ratio control is accomplished by operation of the controller 24 in such a way that fuel mixture is sprayed or injected into each cylinder 11 so as to correspond to driving conditions. The amount of the fuel mixture supplied is increasingly or decreasingly varied in feedback control according to deviations of air/fuel ratios, determined by signals from the upstream exhaust gas sensors 20a and 20b, from a desired or target air/fuel ratio so as to achieve the target air/fuel ratio. A determination that one of the upstream exhaust gas sensors 20a and 20b has deteriorated is made when the upstream exhaust gas sensor 20a or 20b continuously provides an output indicating that the fuel mixture is lean during the period in which the output of the downstream exhaust sensor 22 indicates that the fuel mixture is lean. All of the exhaust gas sensors 20a, 20b and 22 are well known in the art and commercially available.

Prior to providing an explanation of the steps by which the controller 24 determines whether a state of deterioration exists in the upstream exhaust gas sensors 20a and 20b, an explanation will first be provided with reference to time charts shown in FIGS. 3a–3i. The time chart shows the steps by which a determination is made with respect to a potential state of deterioration of, for instance, the right upstream exhaust gas sensor 20a. It is to be noted that outputs of the exhaust gas sensors 20a, 20b and 22 are at a high level "1" when the fuel mixture is rich and at a low level "0" when the fuel mixture is lean. Due to the fact that the right upstream exhaust gas sensor 20a has deteriorated, an output EA from the upstream exhaust gas sensor 20a, shown by a time chart (1), varies between the high and low levels "1" and "0" with a long inversion cycle. On the other hand, because the left upstream exhaust gas sensor 20b has not deteriorated and is in an ordinary state, an output EB from the left upstream exhaust gas sensor 20b, shown by a time chart (2), varies between the high and low levels "1" and "0" with a relatively short inversion cycle as a result of the feedback control of the air/fuel ratio. An output EC from the downstream exhaust gas sensor 22, shown by a time chart (3), is basically at the high level "1," indicating that fuel mixture is rich. Occasionally, the output EC inverts to the low level "0."

Time chart (4) shows the condition of a flag FA representing a rich or lean state of the fuel mixture; this flag may be referred to as a first upstream R/L flag. The condition of the flag FA results from a comparison between an output EA of the right upstream exhaust gas sensors 20a, shown by the time chart (1), and a slice level $E_0$ for determining whether or not the fuel mixture is rich (R) or lean (L). Similarly, a time chart (5) shows the condition of a flag FB representing a rich or lean state of the fuel mixture; this flag may be referred to as a second upstream R/L flag. The condition of the flag FB results from a comparison between an output EB of the left upstream exhaust gas sensors 20b, shown by the time chart (2), and the slice level $E_0$ for determining whether or not the fuel mixture is rich (R) or lean (L). In the same way, a time chart (6) shows the condition of a flag FC representing a rich or lean state of the fuel mixture; this flag may be referred to as a downstream R/L flag. The condition of the flag FC results from a comparison between an output EC of the downstream exhaust gas sensors 22, shown by the time chart (3), and the slice level $E_0$ for determining whether or not the fuel mixture is rich (R) or lean (L). The states "1" and "0" of the flags FA, FG and FG indicate rich (R) and lean (L) conditions, respectively. A time chart (7) shows a count value T of a timer which is cleared to 0 on every inversion of the downstream R/L flag FC.

Shown by a time chart (8) is a first irregularity determination flag GA, indicating the result of a comparison or test of the first upstream exhaust sensor 20a, i.e., a comparison of the first upstream R/L flag FA with the downstream R/L flag FC. The first irregularity determination flag GA is assumed to be set to the state "1" if both the first upstream R/L flag FA and the downstream R/L flag FC are in the same state when the downstream R/L flag FC exhibits an inversion from one state to another. The first irregularity determination flag is assumed to be reset to the state "0" if the first upstream R/L flag FA exhibits an inversion from one state to another before the downstream R/L flag FC shows a subsequent inversion of its state. If the first upstream R/L flag FA is in the state "1" when the downstream R/L flag FC shows a subsequent inversion, such as shown by times "a," "b" and "c," then, the right upstream exhaust gas sensor 20a is judged to be in a state of deterioration. At the times "a," "b" and "c," the warning indicator lamp 25a is turned on to give an alarm. Similarly, shown by a time chart (9) is a second irregularity determination flag GB, indicating the result of a comparison or test of the second upstream exhaust sensor 20b, i.e., a comparison of the second upstream R/L flag FA with the downstream R/L flag FC. The second irregularity determination flag GB is assumed to be set to state "1" if both the second upstream R/L flag FB and the downstream R/L flag FC are in the same state when the downstream R/L flag FC exhibits an inversion from one state to another. The second irregularity determination flag is assumed to be reset to the state "0" if the second upstream R/L flag FB exhibits an inversion from one state to another before the downstream R/L flag FC shows a subsequent inversion of state. If the second upstream R/L flag FB is in the state "1" when the downstream R/L flag FC shows a subsequent inversion, such as is shown at times "d" and "e," then, the left upstream exhaust gas sensor 20b is judged to be in a state of deterioration. At the times "d" and "e," the warning indicator lamp 25b is turned on to give an alarm. In this example, since the second exhaust gas sensor 20b is assumed to be in its ordinary state, when the state of the downstream R/L flag FC is inverted, the second irregularity determination flag GB has not been set to the state "1."

Figure 4:
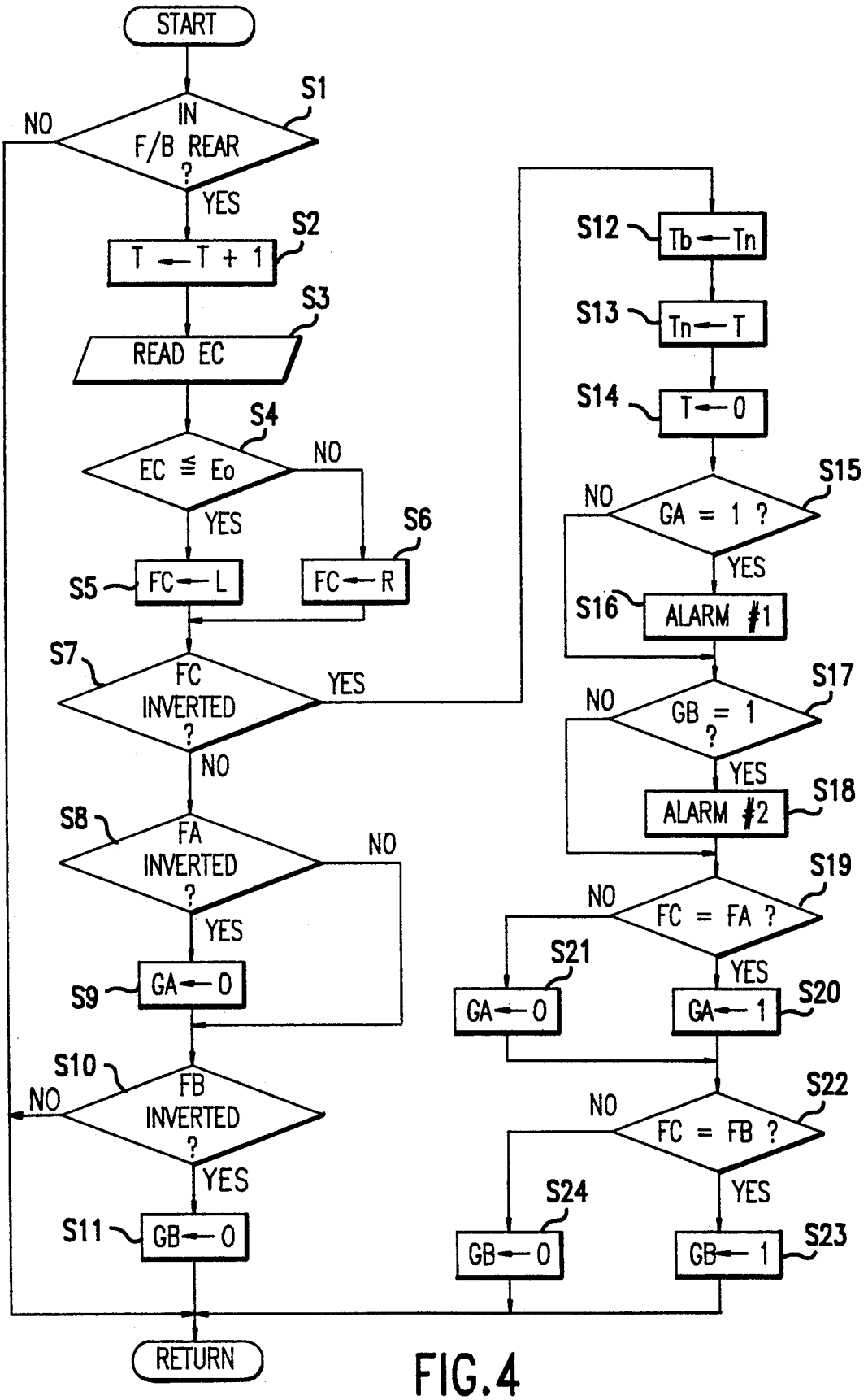
FIG. 4 is a flow chart illustrating an upstream exhaust gas sensor deterioration determination sequence.

The operation of the exhaust gas purification system depicted in FIG. 2 is best understood by reviewing FIG. 4, which is a flow chart illustrating a determination routine of a state of deterioration of the upstream exhaust gas sensors 20a and 20b for the micro-computer of the controller 24. Programming a computer is a skill well understood in the art. The following description is written to enable a programmer having ordinary skill in the art to prepare an appropriate program for the micro-computer. The particular details of any such program would, of course, depend upon the architecture of the particular computer selected.

Referring to FIG. 4, the first step at step S1 is to make a decision, based on an engine speed detected by the engine speed sensor (Ne) 27 and an engine load in estimated by an opening of the throttle valve detected by a throttle valve opening sensor (not shown), as to whether or not the driving condition is in a specific area of driving conditions in which fuel feedback control is performed. If the answer to this decision is "YES," the driving condition is in the specific driving condition area. Then, after incrementing the count of a timer T (this timer is set to 0 when it is initialized) by one (1) at step S2, an output signal EC from the downstream exhaust gas sensor 22 is read in, after analog-to-digital conversion, at step S3. At step S4, a decision is made as to whether or not the output signal EC from the downstream exhaust gas sensor 22 is less than a slice level $E_0$, i.e., whether or not an air/fuel ratio indicates that the fuel mixture is lean. If the answer to the decision is "YES," indicating a lean air/fuel ratio, then, the downstream R/L flag FC is set to "0," which indicates a lean air/fuel ratio, at step S5. Otherwise, if the answer to the decision made at step S4 is "NO," indicating a rich air/fuel ratio, then, the downstream R/L flag FC is set to "1" which indicates a rich air/fuel ratio, at step S6.

Thereafter, a decision is made at step S7 as to whether or not a current state of the downstream R/L flag FC is the same as the previous state. In other words, a decision made as to whether or not the downstream R/L flag FC is inverted with respect to an output level of the downstream exhaust gas sensor 22. When the answer is "YES," this indicates that the output signal EC of the downstream exhaust gas sensor 22 has actually been inverted. Then, after replacing a previously memorized value of a previous inversion time Tb with the value of a current inversion time Tn at step S12, the count value of timer T is set to the current inversion time Tn at step S13. Thereafter, at step S14, the timer T is reset.

At step S15, a decision is made as to whether or not the first irregularity determination flag GA has been set to "1" at step S20 in the previous cycle. After activating the first warning indicator lamp **25*a* to give an alarm at step S16 when the answer to the decision is "YES," or directly after the decision when the answer to the decision is "NO," another decision is made at step S17 as to whether or not the second irregularity determination flag GB has been set to "1" at step S23 in the previous cycle. When the answer to the decision made at step S17 is "YES," then the second warning indicator lamp 25*b* is activated to give an alarm at step S18. After the alarm at step S18, or directly after the decision at step S17 when the answer to the decision is "NO," a decision is made at step S19 as to whether or not the downstream R/L flag FC and the first upstream R/L flag FA are both in the same state, namely, the lean state (L) or the rich state (R). If a "YES" decision is made, then, at step S20, the first irregularity determination flag GA is set to "1." On the other hand, if a "NO" decision is made in step S19, this indicates that the downstream R/L flag FC and the first upstream R/L flag FA are in different states. Then, at step S21, the first irregularity determination flag GA is reset to "0." In the same manner, at step S22, a decision is made as to whether or not the downstream R/L flag FC and the second upstream R/L flag FB are in consistent states. If a "YES" decision is made, then, at step S23, the second irregularity determination flag GB is set to "1." On the other hand, if a "NO" decision is made, then, at step S24**, the second irregularity determination flag GB is reset to "0."

Until the downstream R/L flag FC undergoes another inversion in state after the flag control through step S20 to S24 when a current state of the downstream R/L flag FC has been changed from the previous state, the sequence repeats steps S8 through S11. That is, if the answer to the decision at step S7 is "No," the downstream R/L flag FC is in the same state in the current sequence as it was in the previous sequence. If the answer to the decision made in step S7 is "No," a decision is then made at step S8 as to whether or not the first upstream R/L flag FA has been inverted or changed in state from "0" to "1" or vice versa. If the answer to the decision at step S8 is "YES," this indicates that the state has inverted. Then, at step S9, the first irregularity determination flag GA is reset to "0." After resetting the first irregularity determination flag GA to "0," or directly after the decision made in step S8 when the answer to this decision is "NO," in the same manner, a decision is made at step S10 as to whether or not the second upstream R/L flag FB has been inverted. If the answer to the decision made at step S10 is "YES," this indicates that the second upstream R/L flag FB has been inverted. Then, at step S11, the second irregularity determination flag GB is reset to "0."

As is apparent from the above description, independent detection and warning of deterioration in the upstream exhaust gas sensors **20*a* and 20*b***, which are installed in two independent exhaust systems, are made.

It is to be understood that although the above description has been provided with respect to an exhaust gas purification system installed in a V-type engine, the exhaust gas purification system of this invention may be equipped with various types of engines having two independent exhaust systems.

It is also to be understood that various other embodiments and variants of the exhaust gas purification system which fall in the scope and spirit of the invention may occur to those skilled in the art. Such other embodiments and variants are intended to be covered by the following claims.

What is claimed is:

1. An exhaust gas purification system for use with an internal combustion engine having two groups of cylinders which are, respectively, provided with independent exhaust systems, said independent exhaust systems being merged together as a single downstream exhaust pipe, said exhaust gas purification system comprising:

an upstream exhaust gas sensor, disposed in each of said independent exhaust systems, for detecting a gas component in exhaust gases which varies according to an air/fuel ratio of a fuel mixture so as to provide an output which inverts between a lean state, representative of a lean air/fuel ratio, and a rich state, representative of a rich air/fuel ratio, according to concentrations of said gas component detected by said upstream exhaust gas sensor;

air/fuel ratio control means for controlling an air/fuel ratio, based on said output from said upstream exhaust gas sensor, at which a fuel mixture is delivered into each group of cylinders;

catalytic exhaust gas purification means, disposed in said single downstream exhaust pipe, for purifying exhaust gas passing therethrough;

a downstream exhaust gas sensor, disposed after said catalytic exhaust gas purification means in said single downstream exhaust pipe, for detecting a gas component in exhaust gases which varies according to an air/fuel ratio of a fuel mixture so as to provide an output which inverts between a lean state, representative of a lean air/fuel ratio, and a rich state, representative of a rich air/fuel ratio, according to concentrations of said gas component detected by said downstream exhaust gas sensor; and deterioration determining means for comparing outputs from both said upstream exhaust gas sensor and said downstream exhaust gas sensor, and for determining that said upstream exhaust gas sensor has deteriorated when detecting that said output from said upstream exhaust gas sensor has a predetermined correlation with said output from said downstream exhaust gas sensor while said output from said downstream exhaust gas sensor is kept in a single state.

2. An exhaust gas purification system as defined in claim 1, wherein said deterioration determining means determines that said upstream exhaust gas sensor has deteriorated when said output from said upstream exhaust gas sensor is detected to be in said lean state while said output from said downstream exhaust gas sensor is kept in said lean state.

3. An exhaust gas purification system as defined in claim 1, and further comprising warning means for giving a warning of deterioration when said deterioration determining means determines that said upstream exhaust gas sensor has deteriorated.

4. An exhaust gas purification system as defined in claim 1, wherein said exhaust gas sensor comprises an oxygen sensor for detecting the concentration of oxygen within exhaust gases.

5. An exhaust gas purification system as defined in claim 1, wherein said catalytic exhaust gas purification means comprises a catalytic converter.

* * * * *